US005215362A

United States Patent [19]

Zoellner

[11] Patent Number: 5,215,362

[45] Date of Patent: Jun. 1, 1993

[54] MODULAR FILE KIT AND ASSEMBLY

[75] Inventor: Clemens E. Zoellner, Midland, Mich.

[73] Assignee: United Technologies Automotive, Inc., Dearborn, Mich.

[21] Appl. No.: 738,248

[22] Filed: Jul. 30, 1991

[51] Int. Cl.[5] ..... A47B 88/16

[52] U.S. Cl. ..... 312/246; 312/334.4; 312/334.46; 312/334.23

[58] Field of Search ..... 312/333, 183, 184, 245, 312/246, 334.4, 234.23, 334.46

[56] References Cited

U.S. PATENT DOCUMENTS 4,067,632 1/1978 Sekerich ..... 312/339
4,423,914 1/1984 Vander Ley ..... 312/333
4,473,262 9/1984 Staye ..... 312/333
4,726,635 2/1988 Rariden et al. ..... 312/184
4,735,470 4/1988 Falk ..... 312/246

OTHER PUBLICATIONS

"Mod-U-Line II File Drawer System", Alma Plastics Company, 1983.

*Primary Examiner*—Peter R. Brown
*Attorney, Agent, or Firm*—Dinnin & Dunn

[57] ABSTRACT

A modular file assembly includes a pair of hanger brackets and at least one pair of guides, one of which is attached to each of the hanger brackets and moveable relative to the hanger brackets. The file assembly further includes at least one drawer and a locking assembly for removeably securing the drawer to the guides.

25 Claims, 4 Drawing Sheets

MODULAR FILE KIT AND ASSEMBLY

BACKGROUND OF THE INVENTION

1. Field of the Invention

The present invention relates generally to a file assembly, and more particularly to, a modular file kit and assembly.

2. Description of the Related Art

Typically, file assemblies have been used to hold files which generally contain documents. Conventionally, the file assembly is a cabinet which rests on a support surface such as a floor with drawers that are moveable into and out of the cabinet in a closed and open position, respectively.

To conserve usable floor space, it is desirable to mount or suspend a file assembly underneath a support surface or structure such as a table. A previous file assembly mounted to the underside of a table had opposed sides with drawers disposed therebetween. The sides were metal plates with plastic caps over the ends. The drawers were mounted on guides for movement between open and closed positions.

One disadvantage of the above file assembly was that the drawers typically fell off the guides when moved to the fully open position. Another disadvantage of the file assembly was that it was not stable, but wobbly. Yet another disadvantage of the file assembly was that metal hangers were used on the inside of the drawer to hang files. Still another disadvantage was that the file assembly was not versatile for drawers of different sizes. A further disadvantage was that the file assembly was made substantially of metal, making it heavy in weight.

SUMMARY OF THE INVENTION

It is, therefore, one object of the present invention to provide a modular file assembly.

It is another object of the present invention to provide a file assembly in the form of a kit.

It is yet another object of the present invention to provide a file assembly which prevents the drawers from falling off the guides when moved to the open position.

It is still another object of the present invention to provide a file assembly which can accommodate drawers of different sizes.

It is a further object of the present invention to provide a file assembly which can be mounted to and suspend from the underside of a table.

It is yet a further object of the present invention to provide a file assembly in which the drawers can be easily removed.

It is a still further object of the present invention to provide a light weight file assembly.

It is an additional object of the present invention to provide a new and improved file kit and assembly.

To achieve the foregoing objects, the present invention is a modular file assembly including a pair of hanger brackets and at least one pair of guides, one of which is attached to each of the hanger brackets and moveable relative to the hanger brackets. The file assembly further includes at least one drawer and means for removeably securing the drawer to the guides.

One advantage of the present invention is that the file assembly is modular and versatile to accommodate drawers of different sizes. Another advantage of the present invention is that the file assembly may be provided in the form of a kit. Yet another advantage of the present invention is that the drawers are removeably secured to the guides and do not fall off the guides when moved to the fully open position. Still another advantage of the present invention is that the file assembly is substantially made of a plastic material and is light weight. A further advantage of the present invention is that the file assembly can be mounted to and suspended from the underside of a table.

Other objects, features and advantages of the present invention will be readily appreciated as the same becomes better understood after reading the following description in light of the accompanying drawings.

DESCRIPTION OF THE PREFERRED EMBODIMENT(S)

Figure 1:
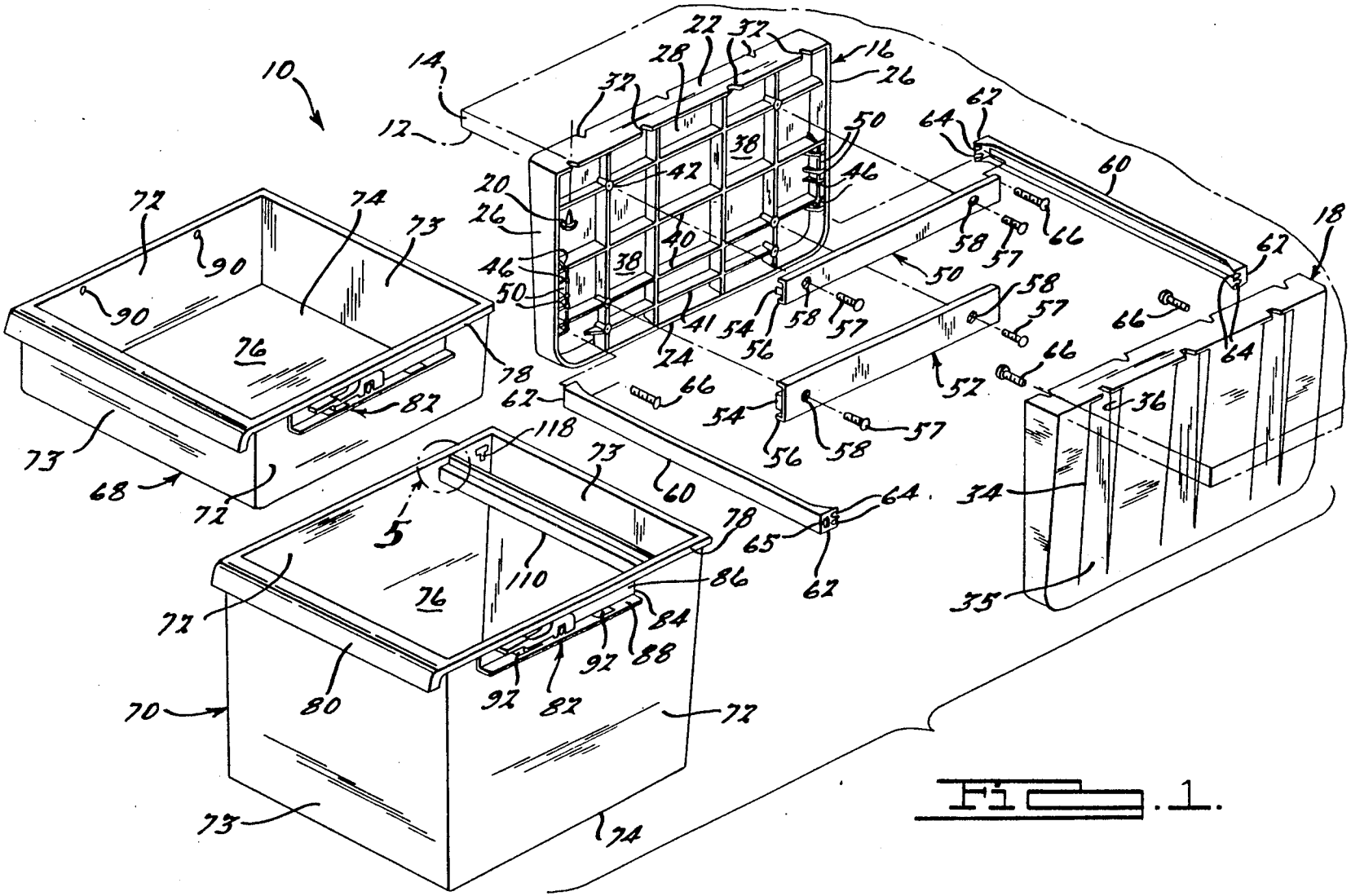
FIG. 1 is an exploded perspective view of a modular file assembly according to the present invention.
Figure 2:
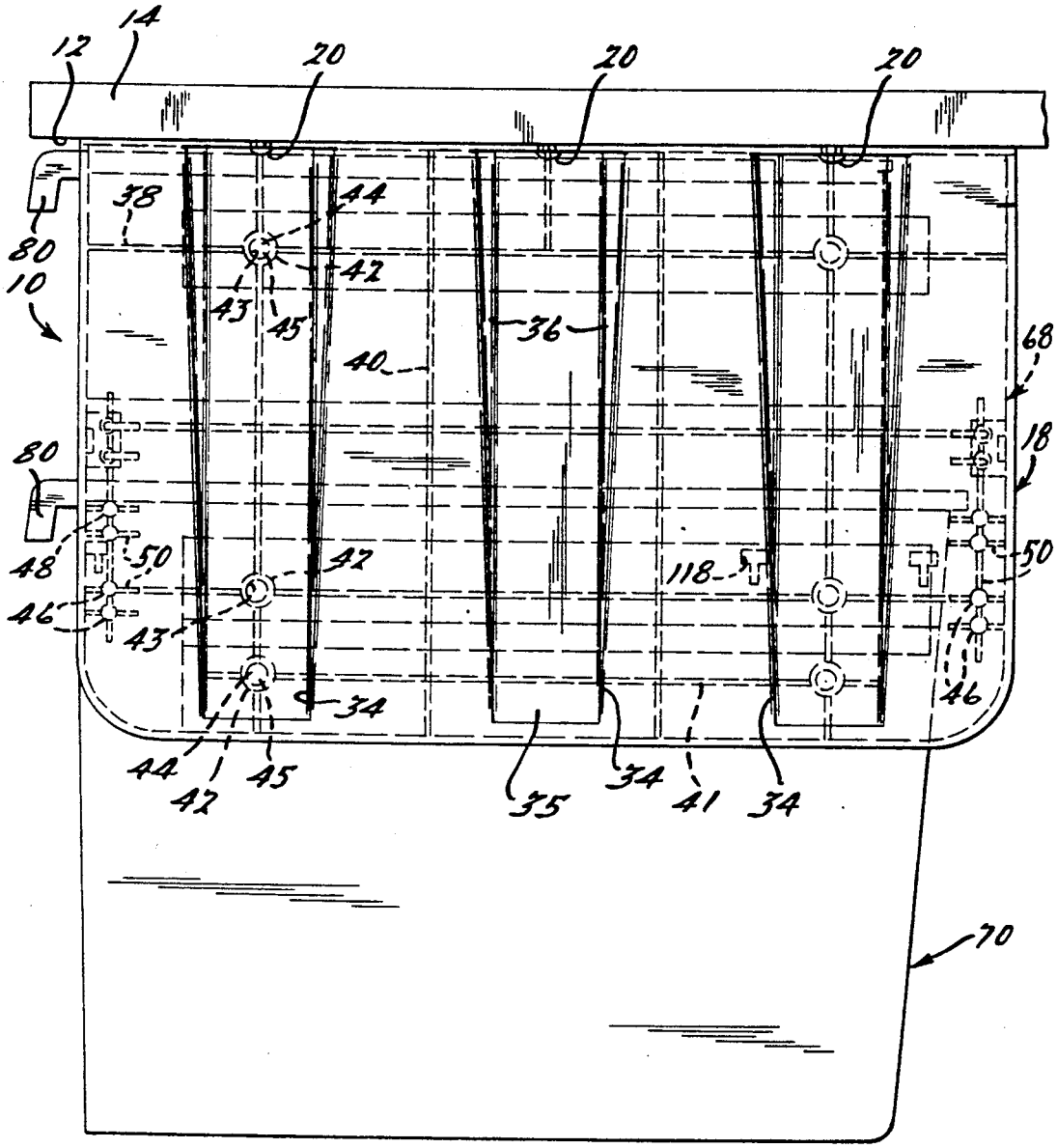
FIG. 2 is a side elevational view of the modular file assembly of FIG. 1.
Figure 3:
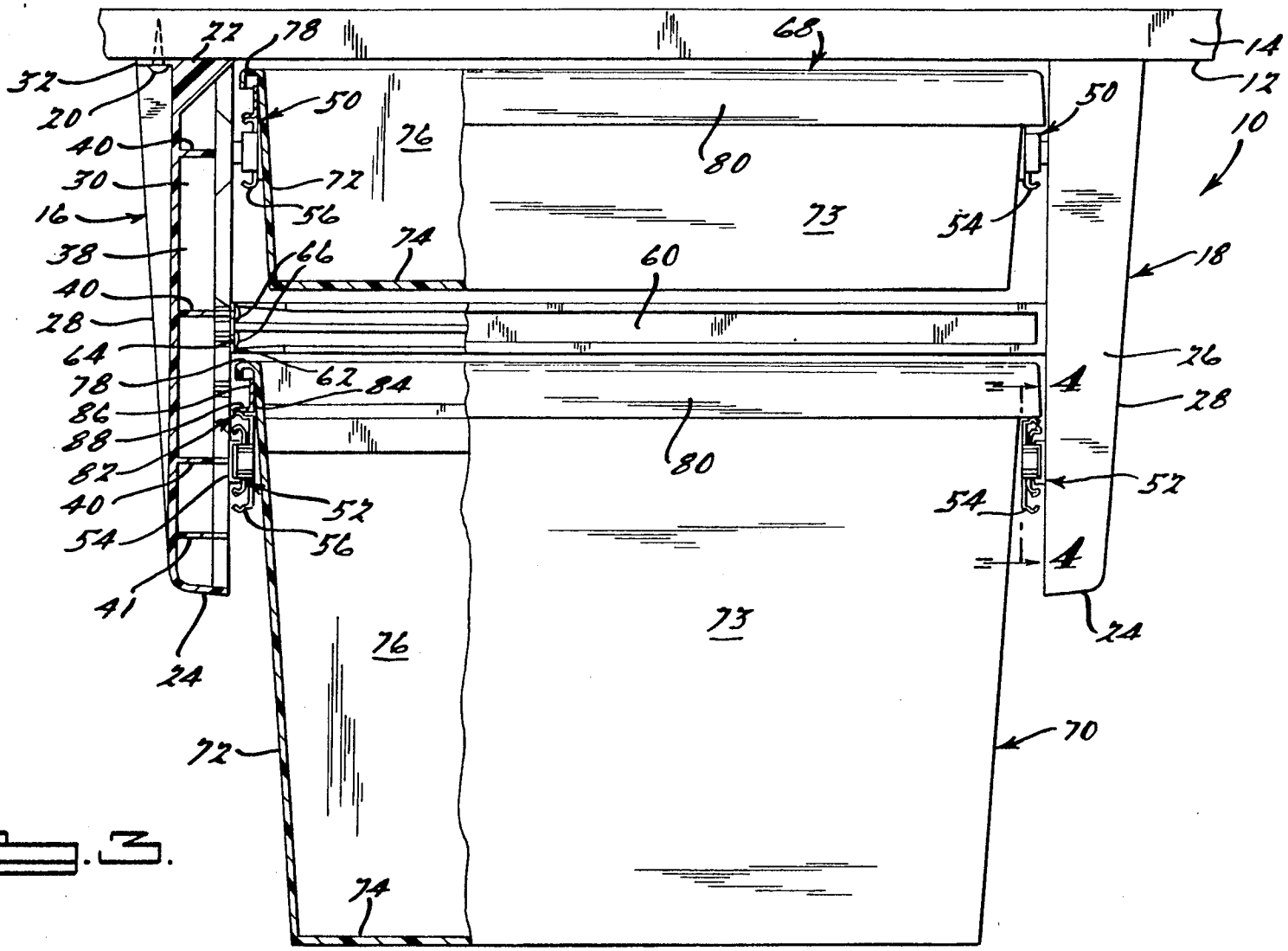
FIG. 3 is a front elevational view of the modular file assembly of FIGS. 1 and 2.

Referring to FIGS. 1 through 3, a modular file assembly 10 according to the present invention is shown. The file assembly 10 is adapted to be mounted to a support surface of a support structure such as the underside 12 of a table 14. It should be appreciated that the underside 12 is generally smooth and planar and the file assembly 10 is suspended from the underside 12 of the table 14.

The file assembly 10 includes a pair of side or hanger brackets, generally indicated at 16 and 18, adapted to be secured to the table 14. The hanger brackets 16 and 18 are symmetrical with the hanger bracket 16 being a left hand bracket and the hanger bracket 18 being a right hand bracket. The hanger brackets 16 and 18 oppose each other and are spaced laterally a predetermined distance. The file assembly 10 includes a plurality of fasteners 20 such as screws to secure the hanger brackets 16 and 18 to the table 14.

The hanger brackets 16 and 18 are generally rectangular in shape and have a top wall 22, bottom wall 24 and side walls 26. The hanger brackets 16 and 18 also have an end wall 28 at one edge of the top, bottom and side walls 22, 24 and 26, respectively, to form a cavity 30. The top wall 22 has a width greater than a width of the bottom wall 24. The top wall 22 is generally smooth and planar and abuts the underside 12 of the table 14. The top wall 22 also has a plurality of notches 32 extending inwardly from an outer periphery thereof. The notches 32 are generally V-shaped in plan view and are spaced longitudinally along each edge of the top wall 22. The fasteners 20 extend through the notches 32 and engage the table 14 to secure the top wall 22 against the underside 12 of the table 14.

The hanger brackets 16 and 18 also include a plurality of, preferably three (3), ribs 34 extending into the cavity 30. The ribs 34 are generally rectangular in shape and have a bottom surface 35 and side surfaces 36 extending from the end wall 28 and sloping inwardly from the bottom wall 24 to the top wall 22. The ribs 34 provide a desired strength or stiffness to the end wall 28 of the hanger brackets 16 and 18. It should be appreciated that some of the notches 32 formed in the top wall 22 are located in the recess formed by the rib 34.

The hanger brackets 16 and 18 further include at least one, preferably a plurality of, first and second interior walls 38 and 40, respectively, disposed within the cavity 30. The first interior walls 38 are generally vertically orientated and extend between the top and bottom walls 22 and 24, respectively. Preferably, four (4) first interior walls 38 are spaced between the side walls 26. The second interior walls 40 are generally horizontally orientated and extend between the side walls 26. Preferably, three (3) second interior walls 40 are spaced between the top and bottom walls 22 and 24, respectively. The hanger brackets 16 and 18 may include a third interior wall 41 extending between a pair of first interior walls 38 and spaced between the bottom wall 24 and a second interior wall 41. The first and second interior walls 38 and 40 provide a lattice with a strength or stiffness for the hanger brackets 16 and 18.

The hanger brackets 16 and 18 also include a plurality of first bosses 42. Preferably, a pair of first bosses 42 are spaced longitudinally and located at intersections of the first and second interior walls 38 and 40 near the top wall 22 and bottom wall 24. Additionally, a pair of first bosses 42 are spaced longitudinally and located at intersections of the first and third interior walls 38 and 41. Each first boss 42 has a cavity 43. The first boss 42 includes an insert 44 made of metal material such as brass which is disposed in the cavity 43 and has a threaded aperture 45. The insert 44 is sonic welded to the first boss 42. It should be appreciated that the insert 44 may be optional and the first boss 42 could include a threaded aperture.

The hanger brackets 16 and 18 further include a plurality of second bosses 46 near the side walls 26. Preferably, three (3) pairs of second bosses 46 are spaced from and extend parallel to each of the side walls 26. The second bosses 46 include an aperture 48 extending therein. The hanger brackets 16 and 18 also include support walls 49 to interconnect the second bosses 46 with each other and the side wall 26 and end wall 28. It should be appreciated that additional support walls may be provided to the hanger brackets 16 and 18 to provide strength or stiffness to other portions.

The hanger brackets 16 and 18 are made of a plastic material. Preferably, the hanger brackets 16 and 18 are made of glass filled polypropylene and may be colored such as white, black, etc. The hanger brackets 16 and 18 may have a textured outer surface. Preferably, each hanger bracket 16 and 18 is a one-piece integral member formed by conventional injection molding.

The file assembly 10 also includes first and second guide assemblies or guides, generally indicated at 50 and 52, adapted to be attached to each of the hanger brackets 16 and 18. The first and second guides 50 and 52 are commonly referred to as ball bearing slides which are conventional and generally known in the art. The first and second guides 50 and 52 have at least an inner and outer bracket 54 and 56 with a generally U-shaped cross-section facing each other and a slider member (not shown) therebetween. The first and second guides 50 and 52 are generally made of metal.

The file assembly 10 includes a plurality of fasteners 57 such as screws to secure the first and second guides 50 and 52 to the hanger brackets 16 and 18. The fasteners 57 extend through apertures 58 in the first and second guides 50 and 52 and engage threaded aperture 45 of the insert 44. Preferably, the first guide 50 is smaller than the second guide 52 and supports a load of lesser weight than the second guide 52. Preferably, the first guide 50 is located at a pair of longitudinally spaced first bosses 42 adjacent the second interior wall 40 near the top wall 22. The second guide 52 is located at a pair of longitudinally spaced first bosses 42 adjacent either the second interior wall 40 or third interior wall 41. It should be appreciated that the inner bracket 54 is fixed relative to the hanger brackets 16 and 18 and the outer bracket 56 moves longitudinally relative to the inner bracket 54 and hanger brackets 16 and 18.

The file assembly 10 also includes at least one, preferably a pair of stabilizer bars 60 adapted to extend between the hanger brackets 16 and 18. The stabilizer bar 60 has a generally C-shaped cross-section and extends laterally. The stabilizer bar 60 has a foot 62 extending longitudinally at each lateral end. The foot 62 has at least one, preferably a pair of notches 64 which are spaced from each other the same distance as a pair of second bosses 46. The foot 62 includes at least on tab 65 to locate the notches 64 relative to the second bosses 46 and the outer surface of the stabilizer bar 60 relative to the outer surface of the side wall 26. The stabilizer bar 60 is made of the same material as the hanger brackets 16 and 18. It should be appreciated that the stabilizer bar 60 may include support walls (not shown) to provide additional strength and stiffness to the stabilizer bar 60. It should also be appreciated that the stabilizer bar 60 is a one-piece integral member formed by conventional injection molding.

The file assembly 10 includes a plurality of fasteners 66 such as screws to secure, the stabilizer bar 60 to the hanger brackets 16 and 18. The fasteners 66 extend through the notches 64 and engage the apertures 48 of the second bosses 46. Preferably, one stabilizer bar 60 is secured near one side wall 26 and another stabilizer bar 60 is secured near the other side wall 26. The stabilizer bars 60 may act as dividers and be located at one of the three pairs of second bosses 46. It should be appreciated that the stabilizer bars 60 provide stability to the file assembly 10 and resist wobbling of the hanger brackets 16 and 18.

The file assembly 10 includes at least one, preferably a pair of first and second drawers, generally indicated at 68 and 70, which are adapted to contain objects such as files. The first and second drawers 68 and 70 are generally rectangular in shape and have side walls 72, end walls 73, and a bottom wall 74 to form a cavity 76 therein. The first and second drawers 68 and 70 have an upper flange 78 extending outwardly from an upper end of the side walls 72 and end walls 73. The upper flange 78 may include a handle portion 80 extending arcuately downward to allow an operator to grasp and move the drawers 68 and 70 longitudinally. It should be appreciated that the handle portion 80 may be optional.

The second drawer 70 has a vertical depth or height greater than a vertical depth or height of the first drawer 68. The first drawer 68 may have a vertical height of four and one-half inches (4½") or six inches (6"). The second drawer may have a vertical height of twelve inches (12"). The first and second drawers 68 and 70 are made of the same material as the hanger brackets 16 and 18. It should be appreciated that the first and second drawers 68 and 70 may include support walls to provide strength and stiffness to portions thereof. It should be also appreciated that each of the first and second drawers 68 and 70 are a one-piece integral member formed by conventional injection molding.

Figure 4:
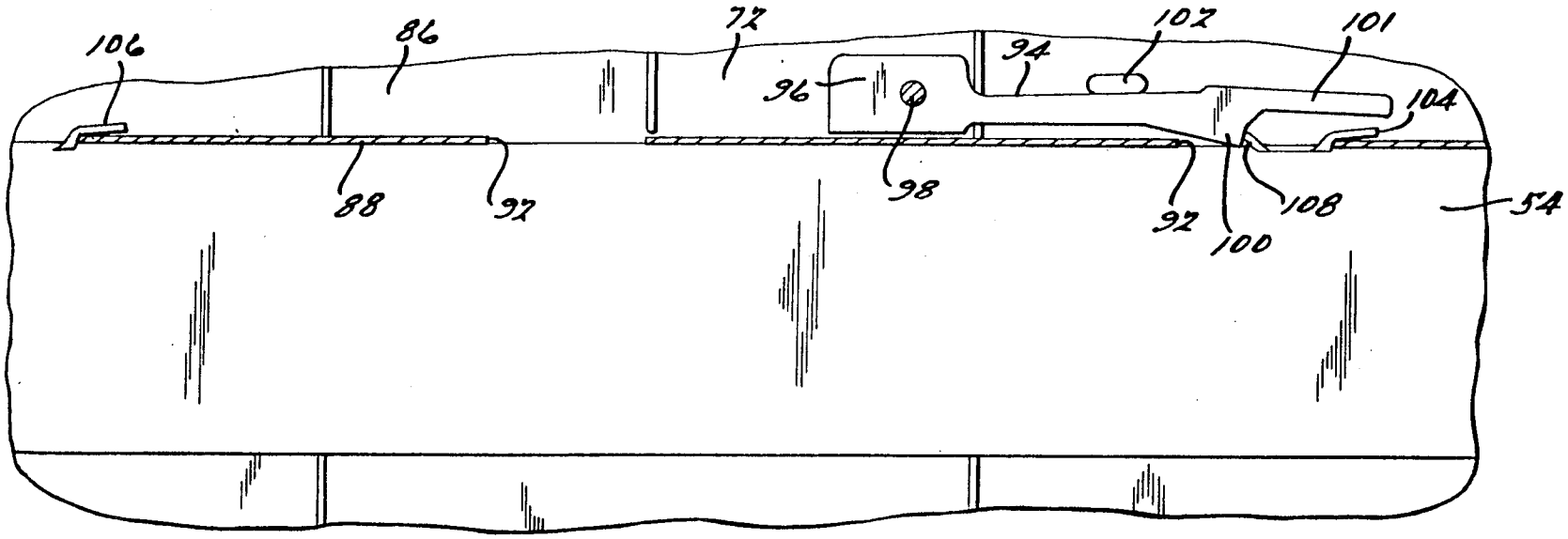
FIG. 4 is a partial sectional view taken along line 4—4 of FIG. 3.

Referring to FIGS. 1 and 4, the file assembly 10 includes a locking assembly, generally indicated at 82, to removeably secure the first and second drawers 68 and 70 to the first and second guides 50 and 52, respectively. The locking assembly 82 includes a bracket 84 attached to each side wall 72 near the upper flange 78 of the first and second drawers 68 and 70 The bracket 84 is generally L-shaped with a vertical portion 86 and a horizontal portion 88. The horizontal portion 88 includes at least one, preferably a pair of locking apertures 92 extending therethrough. The locking apertures 92 are generally rectangular in shape and spaced from each other. The bracket 84 is made of a metal material. The locking assembly 82 also includes a plurality of fasteners 90 such as screws and nuts to secure the bracket 84 to the side wall 72. The fasteners 90 extend through apertures (not shown) in the vertical portion 86 and side walls 72 of the first and second drawers 68.

The locking assembly 82 further includes a locking arm 94 having one end 96 secured to the vertical portion 86 by a fastener 98 such as a rivet. The locking arm 94 extends longitudinally and has a projection 100 extending downwardly and located over one of the locking apertures 92 in the horizontal portion 88. The projection 100 is generally V-shaped. The locking arm 94 also has a lever portion 101 which extends longitudinally of the projection 100. The lever portion 101 is adapted to be moved by an operator upward to move the projection 100 from the locked position of FIG. 4 to an unlocked position. The vertical portion 86 may include a stop 102 extending outwardly to limit the movement of the projection 100 and locking arm 94 upward relative to the horizontal portion 88. The locking arm 94 is made of a plastic material and may move or flex about an axis of fastener 98.

The locking assembly 82 also includes at least one, preferably a first and second slider tab 104 and 106 extending upwardly and longitudinally from an upper edge of the outer bracket 56 of the first and second guides 50 and 52. The first and second slider tabs 104 and 106 have a generally inverted L-shape to form a space between each of the first and second slider tab 104 and 106 and the upper edge of the outer bracket 56 which allows the horizontal portion 88 of the bracket 84 to be disposed therebetween. The first slider tab 104 is adapted to extend through one of the locking apertures 92 and be disposed over a portion of the horizontal portion 88 and the second slider tab 106 is adapted to be disposed over an end of the horizontal portion 88. The locking assembly 82 also includes a locking tab 108 spaced longitudinally from the first slider tab 104 and extending upwardly from the upper edge of the outer bracket 56. The locking tab 108 also extends longitudinally opposite to the first slider tab 104. The locking tab 106 is adapted to extend through the locking aperture 92 and cooperate with the projection 100 of the locking arm 94.

Figure 5:
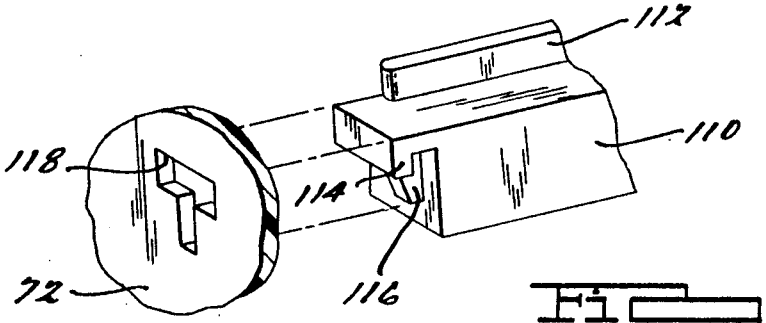
FIG. 5 is a partial exploded perspective view of a portion in circle 5 of FIG. 1.

Referring to FIGS. 1 and 5, the file assembly 10 includes at least one, preferably a pair of hanger bars 110 which are adapted to be disposed in the second drawer 70 to suspend conventional hanging files (not shown) thereon. The hanger bar 110 is generally rectangular in shape and extends laterally between the side walls 72 of the second drawer 70. The hanger bar 110 has a raised flange 112 extending from an upper surface thereof and adapted to cooperate with conventional hanging files. The hanger bar 110 has a hook portion 114 and tab portion 116 at each end. The hook portion 110 and tab portion 112 are adapted to be disposed in and extend through a corresponding apertures 118 in the second drawer 70. The aperture 118 is generally "T" shaped. In the preferred embodiment, the second drawer 70 has a pair of opposed apertures 118 in the side walls 72 near a forward end wall 73 and two pairs of opposed apertures 114 near a rearward end wall 73 to accommodate either letter or legal size conventional hanging files.

The file assembly 10 may be provided in the form of a kit. To assemble the file assembly 10, the first guides 50 are mounted to the upper first bosses 42 by fasteners 57 such that the slider tabs 104 will extend forward toward the edge of the table 14. The second guides 52 are mounted to either pair of lower first bosses 42 depending on the height of the first drawer 68. One stabilizer bar 60 is attached with fasteners 66 into the lower pair of second bosses 46 on one of the hanger brackets 16 and 18. To the same hanger bracket, another stabilizer bar 60 is attached with fasteners 66 to the upper pair of second bosses 46 for the first drawer 68 with a height of 4½" or into the middle pair of second bosses 46 for the first drawer 68 with a height of 6". Both stabilizer bars 60 are then attached to the corresponding second bosses 46 of the other one of the hanger brackets 16 and 18 with fasteners 66.

A template (not shown) having a printed surface may be used to locate the hanger brackets 16 and 18 a predetermined distance such as 1" back from the front edge of the table 14, allowing the first and second drawers 68 and 70 to extend about ¼" out from the edge of the table 14. The template is located to the underside 12 of the table 14 to mark the location for notches 32 of the hanger brackets 16 and 18. The fasteners 20 engage the table 14 at the marked locations until about ¼" from the underside 12 of the table 14. The assembled hanger brackets and stabilizer bars unit is then hooked onto fasteners 20 which are adjusted and tightened. The locking aperture 92 with the projection 100 adjacent thereto is disposed over the first slider tab 104 such that the first slider tab 104 and locking tab 108 extends through the locking aperture 92. The bracket 84 is then moved longitudinally toward the second slider tab 106 such that the projection 100 moves upwardly to the unlocked position and returns to the locked position as illustrated in FIG. 4. When this occurs, the first and second slider tabs 104 and 106 extend longitudinally over a portion of the bracket 84 and the locking tab 108 abuts the projection 100. To remove the drawers 68 and 70, the lever portion 102 is moved upwardly by an operator to the unlocked position and the bracket 84 moved longitudinally away from the second slider tab 10 such that the first slider tab 104 and locking tab 108 may be removed from locking aperture 92.

Accordingly, the file assembly 10 is made of substantially plastic and is light weight. The file assembly 10 may also be colored. The locking assembly 82 allows the drawers 68 and 70 to be removed from the guides 50 and 52 and prevents the drawers 68 and 70 from falling off the guides 50 and 52 when opened. The file assembly 10 is modular such that the first and second drawers 68 and 70 can be removed from one file assembly 10 and secured to another file assembly 10, thus providing interchangeability.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A file assembly comprising:

a pair of hanger brackets;

at least one pair of guides, one of which is attached to each of said hanger brackets and moveable relative to said hanger brackets;

at least one drawer;

means for removeably securing said drawer to said guides;

said securing means comprising locking brackets secured to opposed sides of said drawer and each having at least one locking aperture extending therethrough, a locking tab extending from each of said guides and adapted to extend through said locking apertures and means on each of said locking brackets for cooperating with said locking tab and moveable between a locked and unlocked position.

2. A file assembly comprising:

a pair of hanger brackets;

at least one pair of guides, one of which is attached to each of said hanger brackets and moveable relative to said hanger brackets;

at least one drawer;

means for removeably securing said drawer to said guides;

said securing means comprising locking brackets secured to opposed sides of said drawer and each having at least one locking aperture extending therethrough, locking tabs extending from said guides and adapted to extend through said locking apertures, and means on said locking brackets for cooperating with said locking tabs and moveable between a locked and unlocked position; and wherein said cooperating means comprises a locking arm having one end pivotally secured to said locking bracket and a projection spaced from said one end adjacent said locking aperture to engage and disengage said locking tab in said locked and unlocked positions.

3. A file assembly as set forth in claim 2 including at least one stabilizer bar extending laterally and attached to each of said hanger brackets.

4. A file assembly as set forth in claim 3 including fastening means for securing said stabilizer bar to said hanger brackets.

5. A file assembly as set forth in claim 2 including a pair of second guides spaced vertically from said guides, one of which is attached to each of said hanger brackets and moveable relative to said hanger brackets.

6. A file assembly as set forth in claim 5 including a second drawer secured to said second guides.

7. A file assembly as set forth in claim 6 including second securing means for removeably securing said second drawer to said second guides.

8. A file assembly as set forth in claim 7 wherein said second securing means comprises second locking brackets secured to opposed sides of said second drawer and each having at least one second locking aperture extending therethrough, a second locking tab extending from each of said second guides and adapted to extend through said second locking aperture to said second locking brackets, and means on each of said second locking brackets for cooperating with said second locking tab and moveable between a locked and unlocked position.

9. A file assembly as set forth in claim 2 wherein said hanger brackets are made of a plastic material.

10. A file assembly comprising:

a pair of hanger brackets;

a pair of first guides, one of which is attached to each of said hanger brackets and moveable relative to said hanger brackets;

a first drawer secured to said first guides;

a pair of second guides spaced vertically from said first guides, one of which is attached to each of said hanger brackets and moveable relative to said hanger brackets;

a second drawer secured to said second guides;

means for removeably securing said second drawer to said second guides;

said securing means comprising locking brackets secured to opposed sides of said second drawer and having at least one locking aperture extending therethrough, a locking tab extending from said second guides and adapted to extend through said locking aperture, and means on each of said locking brackets for cooperating with said locking tab and moveable between a locked and unlocked position; and wherein said cooperating means comprises a locking arm having one end pivotally secured to said locking bracket and a projection spaced from said one end adjacent said locking aperture to engage and disengage said locking tab in said locked and unlocked positions.

11. A file assembly as set forth in claim 10 wherein said second drawer has a height greater than a height of said first drawer.

12. A file assembly as set forth in claim 10 wherein said first drawer and said second drawer include a handle portion.

13. A file assembly as set forth in claim 10 including at least one hanger bar adapted to extend between opposed walls of said second drawer.

14. A file assembly as set forth in claim 13 wherein said at least one hanger bar is made of a plastic material.

15. A file assembly as set forth in claim 10 including fastening means for securing said first guides and said second guides to said hanger brackets.

16. A file assembly as set forth in claim 10 wherein said first drawer and said second drawer are made of a plastic material.

17. A file assembly adapted to be suspended from a planar surface, comprising:

a pair of hanger brackets secured to and suspended from a planar surface;

a pair of first guides and a pair of second guides, one of said pair of first and second guides being attached to each of said hanger brackets and moveable relative to said hanger brackets;

a pair of stabilizer bars, each of said stabilizer bars extending laterally and attached to each of said hanger brackets;

a first and second drawer; and means for removeably securing said first and second drawers to said first and second guides, said securing means comprising locking brackets secured to each of opposed sides of said first and second drawers and each having at least one locking aperture extending therethrough, a locking tab extending from each of said first and second guides and adapted to extend through said at least one locking aperture, and means on each of said locking brackets for cooperating with said locking tab and moveable between a locked and unlocked position.

18. A file assembly adapted to be suspended from a planar surface, comprising:

a pair of hanger brackets secured to and suspended from a planar surface;

a pair of first guides and a pair of second guides, one of said pair of first and second guides being attached to each of said hanger brackets and moveable relative to said hanger brackets;

a pair of stabilizer bars, each of said stabilizer bars extending laterally and attached to each of said hanger brackets;

a first and second drawer;

means for removably securing said first and second drawers to said first and second guides;

said securing means comprising locking brackets secured to each of opposed sides of said first and second drawers and each having at least one locking aperture extending therethrough, a locking tab extending from each of said first and second guides and adapted to extend through said at least one locking aperture, and means on each of said locking brackets for cooperating with said locking tab and moveable between a locked and unlocked position; and wherein said cooperating means comprises a locking arm having one end pivotally secured to said locking bracket and a projection spaced from said one end adjacent said locking aperture to engage and disengage said locking tab in said locked and unlocked positions.

19. A file assembly as set forth in claim 18 wherein said first drawer and said second drawer include a handle portion.

20. A file assembly as set forth in claim 19 including at least one hanger bar adapted to extend between opposed walls of said second drawer.

21. A file assembly as set forth in claim 20 wherein said hanger brackets and said first and second drawers are made of a plastic material.

22. A file assembly adapted to be suspended from a planar surface, comprising:

a pair of hanger brackets secured to and suspended from a planar surface;

a pair of first and second guides, one of said pair of first and second guides being attached to each of said hanger brackets and moveable relative to said hanger brackets;

a pair of stabilizer bars, each of said stabilizer bars extending laterally and attached to each of said hanger brackets;

a first and second drawer;

a locking bracket secured to each of opposed sides of said first and second drawers and having at least one locking aperture extending therethrough;

a pair of slider tabs extending axially in one direction from each of said first and second guides and adapted to dispose said locking bracket axially therebetween, one of said slider tabs being adapted to extend through said locking aperture;

a locking tab extending axially in an opposite direction to said slider tabs from each of said first and second guides and adapted to extend through said locking aperture; and a locking arm having one end pivotally secured to said locking bracket and a projection spaced from said one end adjacent said locking aperture and moveable between a locked and unlocked position to engage and disengage said locking tab for preventing axial movement of said locking bracket and removeably securing said first and second drawers to said first and second guides.

23. A modular file kit adapted to be suspended from a planar surface, comprising:

a pair of hanger brackets adapted to be secured to and suspend from a planar surface;

one or more pairs of guides adapted to be attached to each of said hanger brackets and moveable relative thereto and having a locking tab extending therefrom;

one or more drawers adapted to be secured to said guides; at least a pair of locking brackets adapted to be secured to each of opposed sides of said drawers and having at least one locking aperture extending therethrough to allow said locking tab to extend through said locking aperture and a locking arm pivotally secured to said locking brackets and moveable between a locked and unlocked position to engage and disengage the locking tab for removeably securing said drawers to said guides.

24. A modular file kit as set forth in claim 23 including one or more stabilizer bars adapted to extend laterally and be attached to each of said hanger brackets.

25. A modular file kit as set forth in claim 24 including one or more fasteners adapted to secure said guides to said hanger brackets and said stabilizer bars to said hanger brackets.

* * * * *